US006152064A

United States Patent [19]

Morton

[11] Patent Number: 6,152,064

[45] Date of Patent: Nov. 28, 2000

[54] PROTECTIVE COVER FOR A PROPELLER

[76] Inventor: Karen L. Morton, 12 Henna Dr., Stafford, Va. 22554

[21] Appl. No.: 09/377,187

[22] Filed: Aug. 19, 1999

Related U.S. Application Data

[60] Provisional application No. 60/097,114, Aug. 19, 1998.

[51] Int. Cl.[7] ..... B63B 17/00

[52] U.S. Cl. ..... 114/361; 440/113

[58] Field of Search ..... D15/4; D12/317; 114/219, 361; 440/49, 900, 113; 416/146 R, 247 A, 247 R; 150/154, 166, 167

[56] References Cited

U.S. PATENT DOCUMENTS 5,660,136 8/1997 Pignatelli et al. ..... 114/361
5,664,975 9/1997 Carlisle ..... 440/49

*Primary Examiner*—Ed Swinehart
*Attorney, Agent, or Firm*—Rodger H. Flagg

[57] ABSTRACT

A protective propeller cover includes a flexible sleeve into which buoyant material is placed to provide a buoyant enclosure. A flexible propeller cover portion is secured to the flexible sleeve, and the distal end is releasably secured about the propeller. The buoyant enclosure is positioned adjacent to the propeller and is sized to extend above the water line when the propeller is positioned beneath the water line. The buoyant enclosure serves to protect swimmers from direct contact with the propeller when swimming in proximity to the boat. The protective propeller cover apparatus further serves to protect the propeller during transport or storage. The protective propeller cover apparatus further serves as an anchor cover when the boat is underway. The protective propeller cover apparatus further serves as an emergency flotation device.

20 Claims, 3 Drawing Sheets

PROTECTIVE COVER FOR A PROPELLER

This appln claims the benefit of U.S. Ser. No. 60/097,114 filed Aug. 19, 1998.

FIELD OF THE INVENTION

The present invention relates to an apparatus for covering and protecting the propeller of a boat, and for protecting swimmers from accidental injury when swimming in proximity to the boat propeller. The apparatus can also be used for covering an anchor of small boats when not installed on the boat propeller; for protecting passengers from accidental injury when swimming in proximity to the boat propeller, for use as an emergency life support device; and to protect the prop during towing and storage, etc.

More particularly, the invention relates to a covering having a buoyant material disposed adjacent the blades of a propeller of a boat, and which can be quickly secured to the propeller when the propeller is not operating. The buoyant material is sized to extend above the surface of the water, to alert the user when the apparatus is installed upon the propeller.

BACKGROUND OF THE INVENTION

Safety devices and protective devices have been used in the prior art in association with boat propellers. For example, in U.S. Pat. No. 5,246,345 to Adams, Jr., a boat propeller cover is disclosed in which an enclosure is formed by two attached shell halves. The device also prevents theft of the propeller.

A reflective propeller cover is shown in U.S. Pat. No. 5,273,399 to Ojeda. The cover is used during transport of a boat on a trailer, and is reflective.

An outdrive protective apparatus is shown in U.S. Pat. No. 3,587,508 to Pearce. In this patent, a bag is loosely placed around a propeller of a boat to prevent marine growth.

Blade covers for individual boat propeller blades are shown in U.S. Pat. No. 5,527,193 to Doelcher. In this patent, individual blade covers are provided for covering individual propeller blades. Each blade cover is of a rigid material, and protects against injuries which may be caused by the sharp edges of the propeller blades.

A boat propeller case and lock is shown in U.S. Pat. No. 5,469,721 to Pyle. In this patent, a hard shell-like casing is provided to surround the propeller of a boat. The casing can be locked to prevent theft, and includes an alarm device.

U.S. Pat. No. 5,664,975 is directed to a reflective propeller safety cover. The cover includes a bag having a flat bottom wall, and reflector material attached to the flat bottom wall. The reflective cover is useful when the boat is being hauled on a trailer.

From the foregoing, it is seen that it is a problem in the art to provide a device which is readily installed on a boat propeller, and which provides protection against injuries. It is also a problem in the art to mark a propeller being towed with reflective material or other warning materials, for towing on roadways. It is also a problem to provide a compact, inexpensive protective propeller cover which is easily installed and may be locked about the propeller to protect the propeller during transport or storage.

SUMMARY OF THE INVENTION

According to the present invention, a protective propeller cover apparatus provides a buoyant enclosure which is readily installed adjacent to a propeller installed upon a boat. The buoyant enclosure extends above the surface of the water when the propeller is in the water for improved visibility. A flexible propeller cover portion is releasably secured about the propeller to protect swimmers from contact with the propeller when swimming in proximity to the boat. The flexible propeller cover apparatus may also be used when the boat is being stored or towed. The flexible propeller cover apparatus may also be used to cover an anchor while the boat is underway. The flexible propeller cover apparatus may also be used as an emergency flotation device.

An object of the present invention is to provide a manually installable propeller cover for use on boats.

Another object of the present invention is to provide an easily installed anchor cover for anchors of small boats, when the anchor is not in use.

A further object of the present invention is to provide a manually installable propeller cover which has a buoyant portion which projects above the water surface when the propeller is at least partially disposed in water.

Another further object of the present invention is to provide a manually installable propeller cover bearing a warning sign which is readily visible and disposed on the buoyant portion, for increased safety when towing the boat.

Yet another object of the present invention is to provide a buoyant propeller cover which may be used as an emergency flotation device.

These and other objects according to the present invention are accomplished by provision of a protective propeller cover apparatus having a flexible sleeve for receiving buoyant material therein, and a flexible propeller cover portion secured extending from the buoyant enclosure. The propeller cover portion includes a closure apparatus to releasably secure the protective propeller cover to the propeller.

Other objects and advantages of the present invention will be more readily apparent from the following detailed description when read in conjunction with the accompanying drawings.

DETAILED DESCRIPTION OF THE INVENTION

Figure 1:
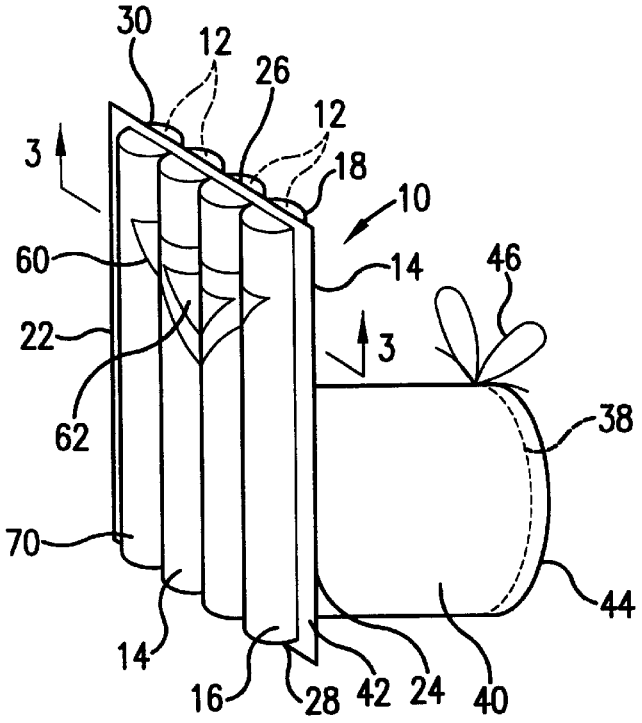
FIG. 1 is a perspective view of the protective propeller cover apparatus according to the present invention.
Figure 2:
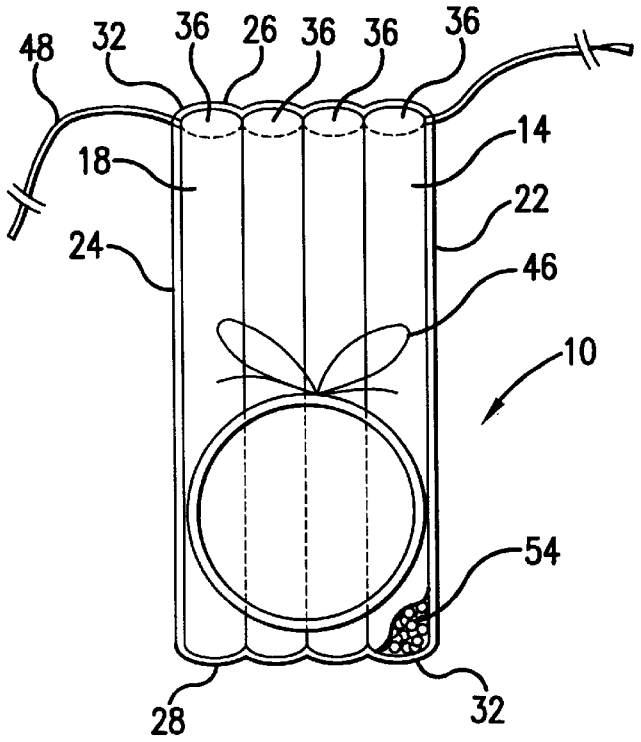
FIG. 2 is an elevational view of the buoyant propeller cover apparatus of FIG. 1.

A protective propeller cover apparatus 10 according to the invention is shown in FIG. 1 through FIG. 7. The protective propeller cover apparatus 10 has a buoyant material 12 enclosed within a flexible sleeve 14. The flexible sleeve 14 comprises a first flexible member 16, and a second flexible member 18. The first and second flexible members 16, 18 are secured together along opposing first and second sides 22, 24, top end portion 26 and bottom end portion 28 by any known means. One or more of the first and second sides 22, 24, top end portion 26 or bottom end portion may be releasably secured for ease of insertion or removal of the buoyant material 12.

The first and second flexible members 16, 18 are preferably made of fabric, cloth or other flexible plastic sheet material which is durable, will withstand extended contact with water, and may be colored to mix or match the colors used on a boat. Alternately, bright safety colors may also be used to fabricate the protective sleeve 14.

Buoyant material 12 is inserted between the first and second flexible members 16, 18 of the flexible sleeve 14 to provide a buoyant enclosure or chamber 30. The top end portion 26 and/or the bottom end portion 28 may be releasably secured 32 for ease of inserting or removing the buoyant material 12 from within the flexible sleeve 14.

The buoyant material 12 is preferably a closed cell foam which may be formed into one or more buoyant elements 34, such as rods, tubes, rectangular sheet, or other suitable configurations. Where more than one buoyant element 34 is used, the flexible sleeve 14 may comprise a series of elongated chambers 36. Each elongated chamber 36 is preferably sized to receive at least one of the multiple elements 34 therein.

Preferably, the buoyant enclosure 30 is sized to extend beyond the width of the propeller, to protect a swimmer who ventures into proximity with the propeller 20, when the boat is anchored or in dock, or when loading or unloading the boat from a boat trailer (not shown).

Where multiple elements 34 are not used, the buoyant material 12 may be in the form of one or more slabs or rectangular sheets of buoyant material 12. Preferably, the buoyant material 12 is from one-half of an inch to six inches thick, wide enough to substantially cover the width of the propeller 20, and long enough to extend out of the water 58 when the propeller 20 is lowered into the water 58.

The top and/or bottom portions 26, 28 of the flexible enclosure 30 may be releasably secured 32 by any known means, such as buttons, clasps, hooks, hook and loop fasteners, etc. Securement of the first flexible member 16 to the second flexible member 18 may also be accomplished by sewing, stitching, heat sealing, sonic welding, gluing, rivets, grommets, fasteners, or other known means of securing a first flexible member 16 to a second flexible member 18.

Alternately, the first and second flexible members 16, 18 may be made of an air impervious material, with a valve 70 provided to selectively inflate or deflate one or more chambers 30.

The flexible propeller cover portion 40 has a first end 42 and a second open end 44 sized to fit loosely over the boat propeller 20, and to substantially enclose the propeller 20 within the cover portion 40. The first end 42 of the flexible propeller cover portion 40 is secured by any known means to the second flexible member 18 of the flexible sleeve 14. The second open end 44 of the flexible propeller cover portion 40 includes a releasable securement means 46, such as a drawstring or hook and loop type closure, to releasably secure the propeller cover portion 40 about the propeller 20. Suitable loops 38 or folds may be used in proximity to the distal end 44 to receive the releasable securement means 46, as is well known in the art.

A releasable securement means 48 may also be used to releasably secure the top portion 26 and/or the bottom portion 28 of the flexible sleeve 14. The releasable securement means 48 may be in the form of a drawstring, cord, hook and loop type fastening means, buttons, clasps, clips, expandable band, or other known releasable fastening means, which is adapted to be releasably secured during installation or removal of the protective propeller cover apparatus 10. Where a drawstring is used, suitable loops 38 may be provided in proximity to the second open end 44 of the flexible propeller cover portion 40.

Figure 7:
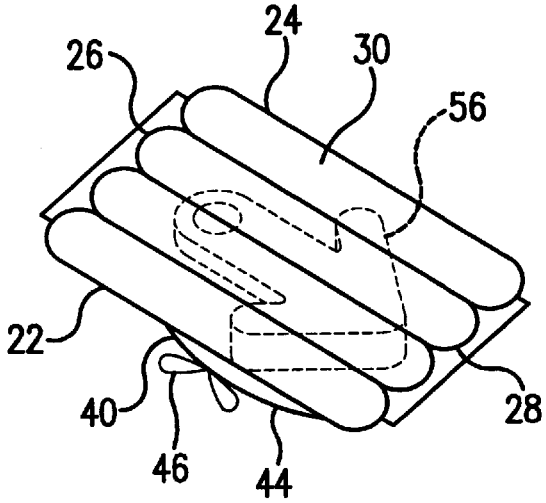
FIG. 7 is a cross sectional view of the protective cover apparatus 10 installed upon an anchor.

When not in use as a protective propeller cover apparatus 10, the protective propeller cover apparatus 10 may also be used to cover the anchor 56 on a boat, as shown in FIG. 7, to protect the user from inadvertent contact with the anchor 56 while the boat is underway.

The protective propeller cover apparatus 10, may also be used as an emergency buoyant apparatus, in the event of an emergency when the boat is in water.

The protective propeller cover apparatus 10 may also be installed upon the propeller 20, to protect the propeller during transport or storage, and to further protect the user from inadvertent contact with the propeller 20 while loading or unloading the boat from a trailer.

Indicia 60 may be placed upon the first flexible surface 16 of the flexible sleeve 14. The indicia 50 may be made of reflective material 62, for added safety when the boat is being towed.

The protective propeller cover apparatus 10 is flexible, so that it may be rolled up or folded for ease of transport and storage, when not installed on a boat propeller 20. This is important where the protective propeller cover apparatus 10 is stowed upon the boat, due to limited cargo and deck space.

In use, the protective propeller cover apparatus 10 is installed by pulling the distal end 44 of the flexible propeller cover portion 40 over the propeller 20 of a boat. This is preferably done when the propeller 20 is at least partially pulled out of the water 58, but it can also be performed while the propeller 20 is completely under water 58 if desired. Once the flexible propeller cover portion 40 is installed upon the propeller 20, the first releasable fastening means 46 is used to releasably secure the protective propeller cover apparatus 10 to the propeller 20.

Preferably, the top end portion 26 of the flexible sleeve 14 includes a cord 52 which is sized to extend about the housing 50 to releasably secure 48 the propeller cover apparatus 10 to the boat housing 50.

The buoyant enclosure 30 floats, placing the top end portion 26 at least partially above the surface of the water 58, when the propeller is lowered into its running position. This provides a visual indication that the protective propeller cover apparatus 10 is installed upon the propeller 20. This is important to ensure that the propeller is not driven until the protective propeller cover apparatus is removed from the propeller 20.

Thus, the buoyant enclosure 30 serves to protect swimmers and passers-by from injuries due to accidental contact with the blades of the propeller 20. Additionally, indicia 60 provides a visual warning to help swimmers and passers-by avoid contact with the blades of the propeller 20. At When the boat is being towed, indicia 60 provides a visual warning to motorists and passers-by of the presence of the propeller 20 extending beyond the profile of the boat.

The protective propeller cover apparatus 10 according to the present invention can be manufactured in a variety of sizes, to fit a variety of sizes of propellers and/or anchors. One or two sizes will fit most inboard/outboard pleasure craft, as well as most outboard boat engines.

Figure 3:
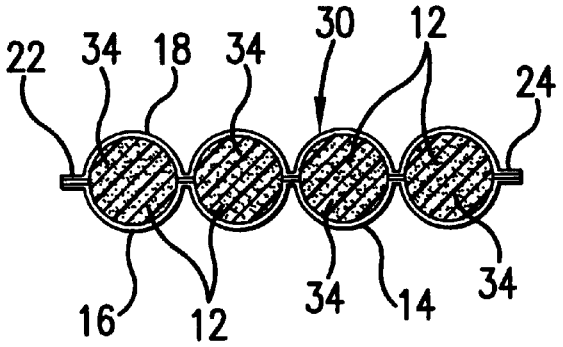
FIG. 3 is a sectional view of the buoyant propeller cover apparatus taken along line 3—3 in FIG. 2.
Figure 4:
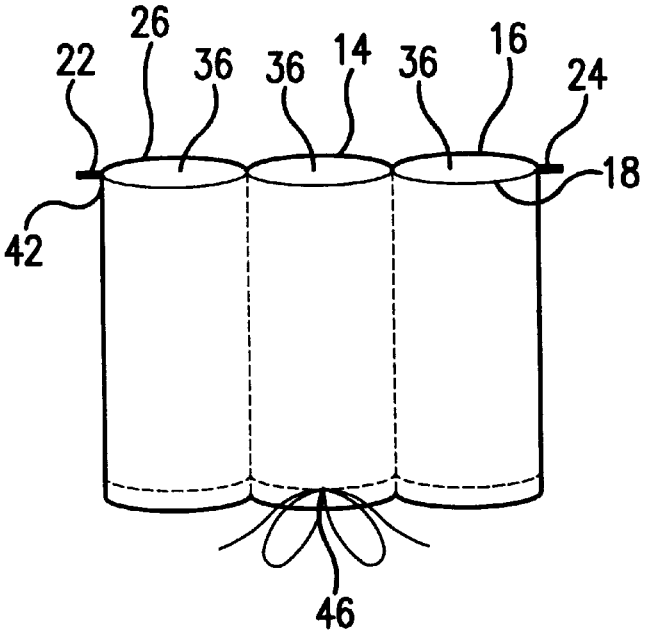
FIG. 4 is a top elevational view of the protective propeller cover apparatus of FIG. 1.

Four multiple elements 34 are shown in FIG. 3, however the number of multiple elements 34 is a matter of design choice. A larger or smaller number of multiple elements 34 can be provided, and all such variations are contemplated as being within the scope of the present invention.

Figure 5:
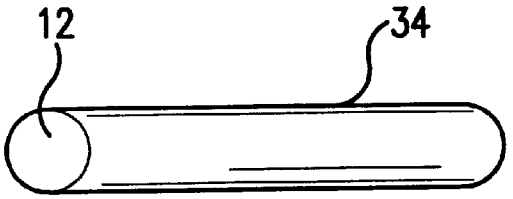
FIG. 5 is a perspective view of a buoyant element for use in the protective propeller cover apparatus of FIG. 1.
Figure 6:
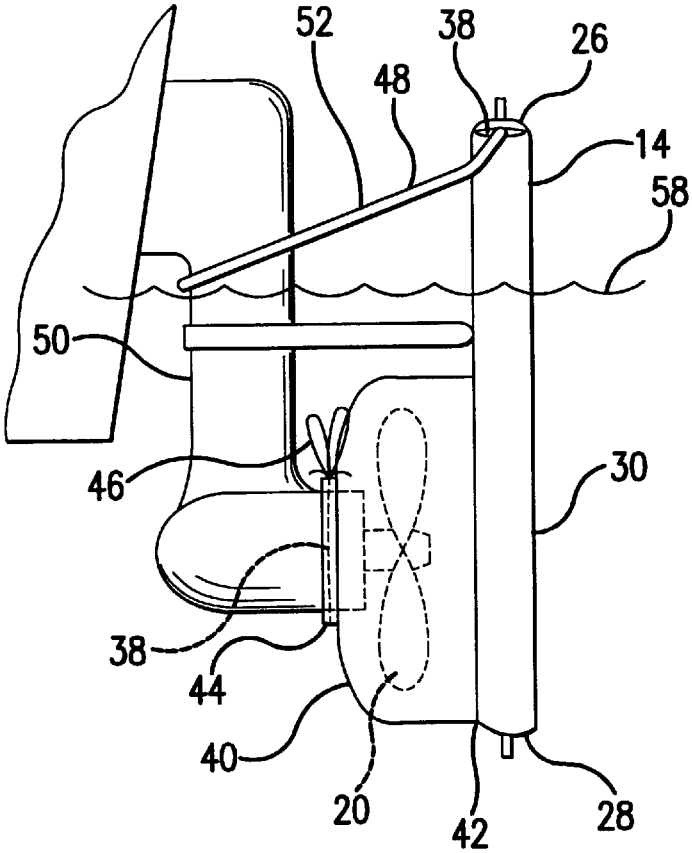
FIG. 6 is a side view of the protective propeller cover apparatus mounted upon an inboard/outboard propeller on a boat.

FIG. 5 is a perspective view of one of the multiple elements 34 for use in the buoyant enclosure 30 of the protective propeller cover apparatus 10. Each of the multiple elements 34 can be formed in different shapes or sizes, having either circular, rectangular or multi-shaped cross sections, such as spherical, square, triangular, oval or multi-sided cross section profiles, by way of example. A number of multiple elements may be adapted to fit within each of the elongated chambers 35 to provide the desired buoyancy within the buoyant enclosure 30. For example, multiple buoyant beads or irregular shapes 54 may also be used within the buoyant enclosure 30, without departing from the scope of this disclosure, nor from the following claims.

Indicia 60, such as symbols, letters, numbers, etc. may be used on the first flexible member 16 of the flexible sleeve 14 to improve safety during use of the protective propeller cover apparatus 10. This is particularly important when towing the boat on a boat trailer, or when the boat is stored, to avoid injury when inadvertently contacting the sharp edges of the propeller 20.

The invention being thus described, it will be evident that the same may be varied in many ways. Such variations are not to be regarded as a departure from the spirit and scope of the invention and all such adaptations and modifications are intended to be included within the scope of the following claims.

I claim:

1. A protective cover apparatus for selective attachment to an existing propeller, comprising:

a) a flexible sleeve having a first flexible member and a second flexible member secured together along opposing first and second sides and upper and lower ends, the flexible sleeve sized to be as wide or wider than said propeller, with an upper end of the flexible sleeve sized to extend above a waterline when said propeller is positioned below the waterline, the flexible sleeve having at least one chamber located between the opposing first and second sides and upper and lower ends of the flexible sleeve, for retaining at least one buoyant material within said at least one chamber;

b) a flexible propeller cover portion having a first end and a second open end sized to fit loosely over said propeller, to substantially enclose said propeller within the flexible propeller cover portion; the first end of the flexible propeller cover portion is secured to the second flexible member of the flexible sleeve near the lower end of the flexible sleeve, and the second open end of the flexible propeller cover portion is adapted to be releasably secured about said propeller with a releasable securement means; and wherein said propeller may be raised from the water for ease of insertion or removal of the protective cover apparatus about said propeller, and then lowered into the water to protect nearby swimmers from contacting said propeller in the water, and wherein the upper end of the flexible sleeve extends above the water to alert swimmers that the protective cover is in place adjacent to said propeller.

2. The protective cover apparatus of claim 1, wherein the first and second flexible members of the flexible sleeve are made of material selected from: fabric, cloth, plastic or rubber material.

3. The protective cover apparatus of claim 1, wherein more than one chamber is located between the first and second flexible members of the flexible sleeve, and said at least one buoyant material is more than one buoyant material retained within said more than one chamber.

4. The protective cover apparatus of claim 1, wherein the buoyant material is a closed cell foam material sized to be received within said at least one chamber.

5. The protective cover apparatus of claim 1, wherein at least one of the opposing sides, upper end and lower end of the flexible sleeve is releasably secured together for ease of selectively inserting and removing the buoyant material from said at least one chamber.

6. The protective cover apparatus of claim 1, wherein the releasable securement means is selected from: a cord, drawstring, resilient member, snaps, catches, clasps, zipper, hook and loop fastener, or elastic band.

7. The protective cover apparatus of claim 1, wherein the protective cover apparatus is secured about said propeller with a locking means during transport and storage.

8. The protective cover apparatus of claim 1, wherein indicia is placed upon the flexible sleeve above the waterline to alert others to the presence of said propeller.

9. The protective cover apparatus of claim 1, wherein the flexible material used to form the first and second flexible members is adapted to form an air tight chamber, and a valve is provided to selectively inflate and deflate at least one chamber to provide buoyancy during use, and to allow the protective cover apparatus to be deflated, and rolled up for compact storage when not in use.

10. A protective cover apparatus of claim 1, wherein the flexible cover portion is secured about said propeller with a releasable locking means to reduce the likelihood of theft of said propeller during transport or storage.

11. A protective cover apparatus for an existing propeller, comprising:

a) a flexible sleeve having a first flexible member and a second flexible member secured together along opposing first and second sides and at least one of an upper end and a lower end, the flexible sleeve sized to be at least as wide as said propeller, with an upper end sized to extend above a body of water, and a lower end sized to cover an end of said propeller when said propeller is lowered into the water, the flexible sleeve having at least one chamber for receiving at least one buoyant material therein, and at least one of said buoyant material is releasably secured within said at least one chamber along at least one of said upper end and said lower end;

b) a flexible cover portion having a first end and a second open end sized to fit loosely over said propeller, and to substantially enclose said propeller therein; the first end of the flexible cover portion is secured to the second flexible member of the flexible sleeve near the lower end of the flexible sleeve, and the second open end of the flexible cover portion is adapted to be releasably secured about said propeller with a releasable securement means; and c) a releasable locking means is provided to secure the flexible cover portion about said propeller to reduce the likelihood of theft of said propeller.

12. The protective cover apparatus of claim 11, wherein the first and second flexible members of the flexible sleeve are made of material selected from: fabric, cloth, plastic or rubber material.

13. The protective cover apparatus of claim 11, wherein more than one piece of buoyant material is inserted within more than one chamber located between said first and second flexible members of the flexible sleeve.

14. The protective cover apparatus of claim 11, wherein the buoyant material is a closed cell foam material in cylindrical form.

15. The protective cover apparatus of claim 11, wherein the buoyant material is a closed cell foam in rectangular sheet form.

16. The protective cover apparatus of claim 11, wherein the releasable securement means is selected from: a cord, drawstring, resilient member, snaps, catches, clasps, zipper, hook and loop fastens or elastic band.

17. The protective cover apparatus of claim 11, wherein the buoyant material is closed cell foam in multiple particulate form.

18. The protective cover apparatus of claim 11, wherein indicia is placed upon the flexible sleeve above the waterline to alert others to the presence of said propeller during use, transport and storage.

19. The protective cover apparatus of claim 11, wherein the flexible material used to form the first and second flexible members is adapted to form an air tight chamber, and a valve is provided to selectively inflate and deflate at least one chamber to provide buoyancy to the protective cover apparatus during use, and to allow the protective cover apparatus to be rolled up for compact storage when not in use.

20. A protective cover apparatus for selective attachment to an existing propeller, comprising:

a) a flexible sleeve having a first flexible member and a second flexible member secured together along opposing first and second sides and opposing first and second ends, the flexible sleeve sized to be as wide or wider than the propeller, with an upper end sized to extend above a body of water, and a lower end sized to cover an end of the propeller when said propeller is lowered into the water; the flexible material used to form the first and second flexible members may be adapted to form at least one air tight chamber, and a valve is provided to selectively inflate and deflate said at least one chamber to provide buoyancy to the protective sleeve during use, and to allow the protective propeller cover apparatus to be rolled up for compact storage when not in use;

b) a flexible propeller cover portion having a first end and a second open end sized to fit loosely over said propeller and to substantially enclose said propeller therein; the first end of the flexible propeller cover portion is secured to the second flexible member of the flexible sleeve near the lower end of the flexible sleeve, and the open end of the flexible propeller cover portion is adapted to be releasably secured about said propeller with a releasable securement means.

* * * * *